US009261836B2

(12) United States Patent
Tanioka

(10) Patent No.: US 9,261,836 B2
(45) Date of Patent: Feb. 16, 2016

(54) MEMBER FOR USE IN FIXING DEVICE, FIXING DEVICE, AND IMAGE FORMING APPARATUS

(71) Applicant: FUJI XEROX CO., LTD., Minato-ku, Tokyo (JP)

(72) Inventor: Yoshiyasu Tanioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/462,768

(22) Filed: Aug. 19, 2014

(65) Prior Publication Data

US 2015/0268595 A1 Sep. 24, 2015

(30) Foreign Application Priority Data

Mar. 18, 2014 (JP) ..... 2014-055495

(51) Int. Cl.
*G03G 15/20* (2006.01)

(52) U.S. Cl.
CPC ..... *G03G 15/206* (2013.01)

(58) Field of Classification Search
CPC ..... G03G 15/206
USPC ..... 399/333
See application file for complete search history.

(56) References Cited

U.S. PATENT DOCUMENTS

| | | | | |
|---|---|---|---|---|
| 5,722,026 | A * | 2/1998 | Goto | G03G 15/2057 399/331 |
| 2005/0220510 | A1 | 10/2005 | Tsunoda | |
| 2009/0285611 | A1 * | 11/2009 | Omata et al. | 399/333 |
| 2012/0251208 | A1 * | 10/2012 | Hasegawa | 399/329 |

FOREIGN PATENT DOCUMENTS

| | | | |
|---|---|---|---|
| JP | 2001-317538 | A | 11/2001 |
| JP | 2005-316364 | A | 11/2005 |
| JP | 2005316364 | A * | 11/2005 |
| JP | 2006058684 | A * | 3/2006 |
| JP | 2006-208659 | A | 8/2006 |

* cited by examiner

*Primary Examiner* — David Gray
*Assistant Examiner* — Tyler Hardman
(74) *Attorney, Agent, or Firm* — Sughrue Mion, PLLC

(57) ABSTRACT

A member for use in a fixing device includes a base member that has a substantially cylindrical shape, and a covering member with which an outer peripheral surface of the base member is covered, the covering member including a first release layer that contains a first fluorocarbon resin and a second release layer that contains a second fluorocarbon resin and that is stacked on an area in the outer peripheral surface of the first release layer other than end portions of the outer peripheral surface of the first release layer in a width direction. In the covering member, a coefficient of kinetic friction of the outer peripheral surface of the first release layer that is exposed at ends of the member for use in a fixing device in the width direction is greater than a coefficient of kinetic friction of an outer peripheral surface of the second release layer.

14 Claims, 6 Drawing Sheets

MEMBER FOR USE IN FIXING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2014-055495 filed Mar. 18, 2014.

BACKGROUND

Technical Field

The present invention relates to a member for use in a fixing device, a fixing device, and an image forming apparatus.

SUMMARY

According to an aspect of the invention, there is provided a member for use in a fixing device including a base member that has a substantially cylindrical shape and a covering member with which an outer peripheral surface of the base member is covered, the covering member including a first release layer that contains a first fluorocarbon resin and a second release layer that contains a second fluorocarbon resin and that is stacked on an area in the outer peripheral surface of the first release layer other than end portions of the outer peripheral surface of the first release layer in a width direction. In the covering member, a coefficient of kinetic friction of the outer peripheral surface of the first release layer that is exposed at ends of the member for use in a fixing device in the width direction is greater than a coefficient of kinetic friction of an outer peripheral surface of the second release layer.

BRIEF DESCRIPTION OF THE DRAWINGS

Exemplary embodiments of the present invention will be described in detail based on the following figures, wherein.

DETAILED DESCRIPTION

Figure 1:
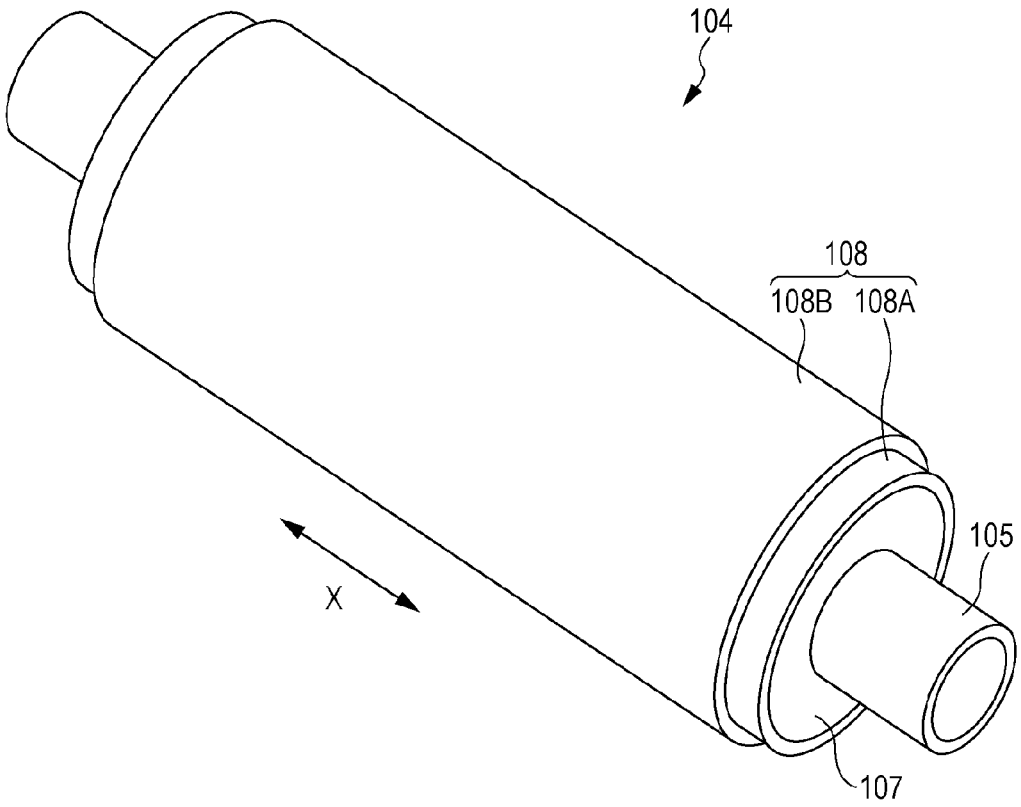
FIG. 1 is a schematic diagram illustrating an example (a pressure roller) of a member for use in a fixing device according to a first exemplary embodiment.

Exemplary embodiments of the present invention will be described in detail below with reference to the drawings.

<Member for Use in Fixing Device>

A member for use in a fixing device according to a first exemplary embodiment includes a base member that has a cylindrical shape or a substantially cylindrical shape and a covering member with which the outer peripheral surface of the base member is covered, the covering member including a first release layer that contains a first fluorocarbon resin and a second release layer that contains a second fluorocarbon resin and that is stacked on an area in the outer peripheral surface of the first release layer other than end portions of the outer peripheral surface of the first release layer in a width direction. In the covering member, the coefficient of kinetic friction of portions of the outer peripheral surface of the first release layer that are exposed at the ends of the member for use in a fixing device in the width direction is greater than the coefficient of kinetic friction of the outer peripheral surface of the second release layer.

In the member for use in a fixing device according to the first exemplary embodiment, the covering member that forms the outer peripheral surface of the member for use in a fixing device contains a fluorocarbon resin and has a structure in which the first release layer and the second release layer each of which has a different coefficient of kinetic friction are stacked on top of one another. Since the outer peripheral surface of the second release layer, which has a small coefficient of kinetic friction, is exposed in an area through which a recording medium passes other than the end portions of the member for use in a fixing device in the width direction, the ability of the member for use in a fixing device to allow the recording medium or toner to easily separate therefrom due to the fluorocarbon resin is maintained, and attachment of a recording medium or adhesion of toner is suppressed. On the other hand, since the outer peripheral surface of the first release layer, which has a coefficient of kinetic friction greater than that of the second release layer, is exposed at the end portions of the member for use in a fixing device in the width direction through which a recording medium will not pass, transmission of a driving force between the member for use in a fixing device and another member in a fixing device is maintained, foreign objects are less likely to adhere to the end portions as compared with the case where an elastic member is disposed at each of the end portions, and contamination of the end portions and a reduction in the transmission of the driving force are suppressed.

The member for use in a fixing device according to the first exemplary embodiment may be applied to both a roll-shaped member and a belt-shaped member each of which is to be used in a fixing device, and the case where the member for use in a fixing device according to the first exemplary embodiment is applied to a pressure roller or a fixing roller will be mainly described below as a representative example.

<Pressure Roller>

Figure 2:
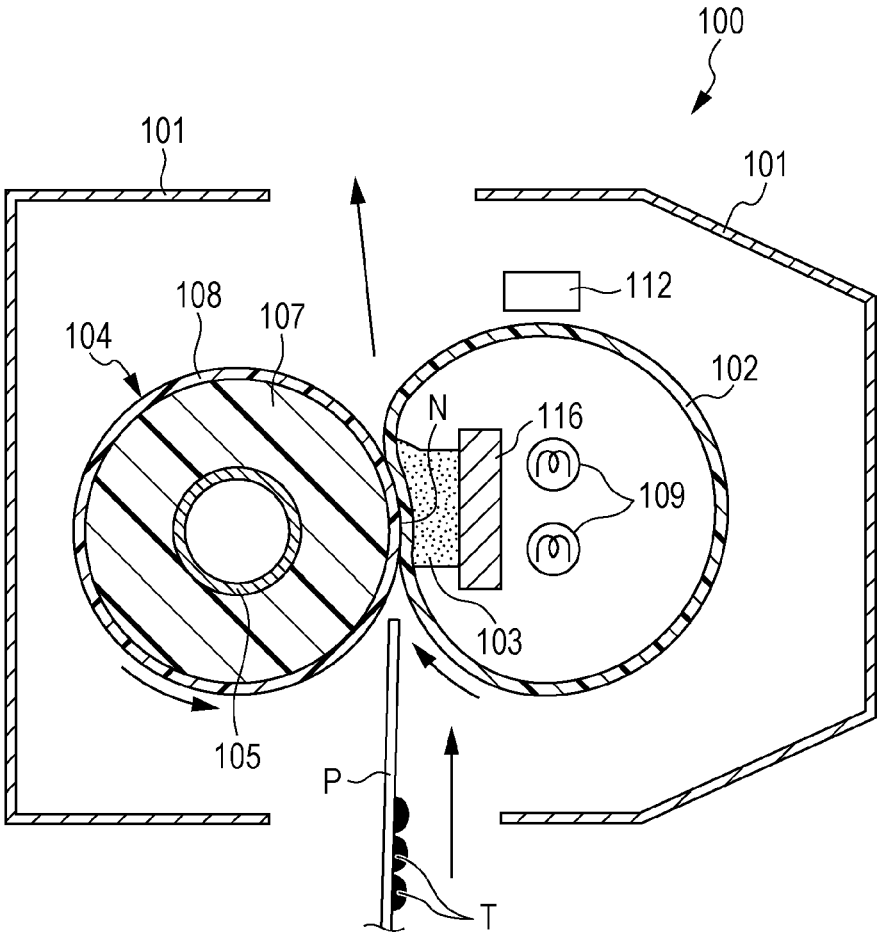
FIG. 2 is a schematic diagram illustrating the configuration of a fixing device according to the first exemplary embodiment.
Figure 3:
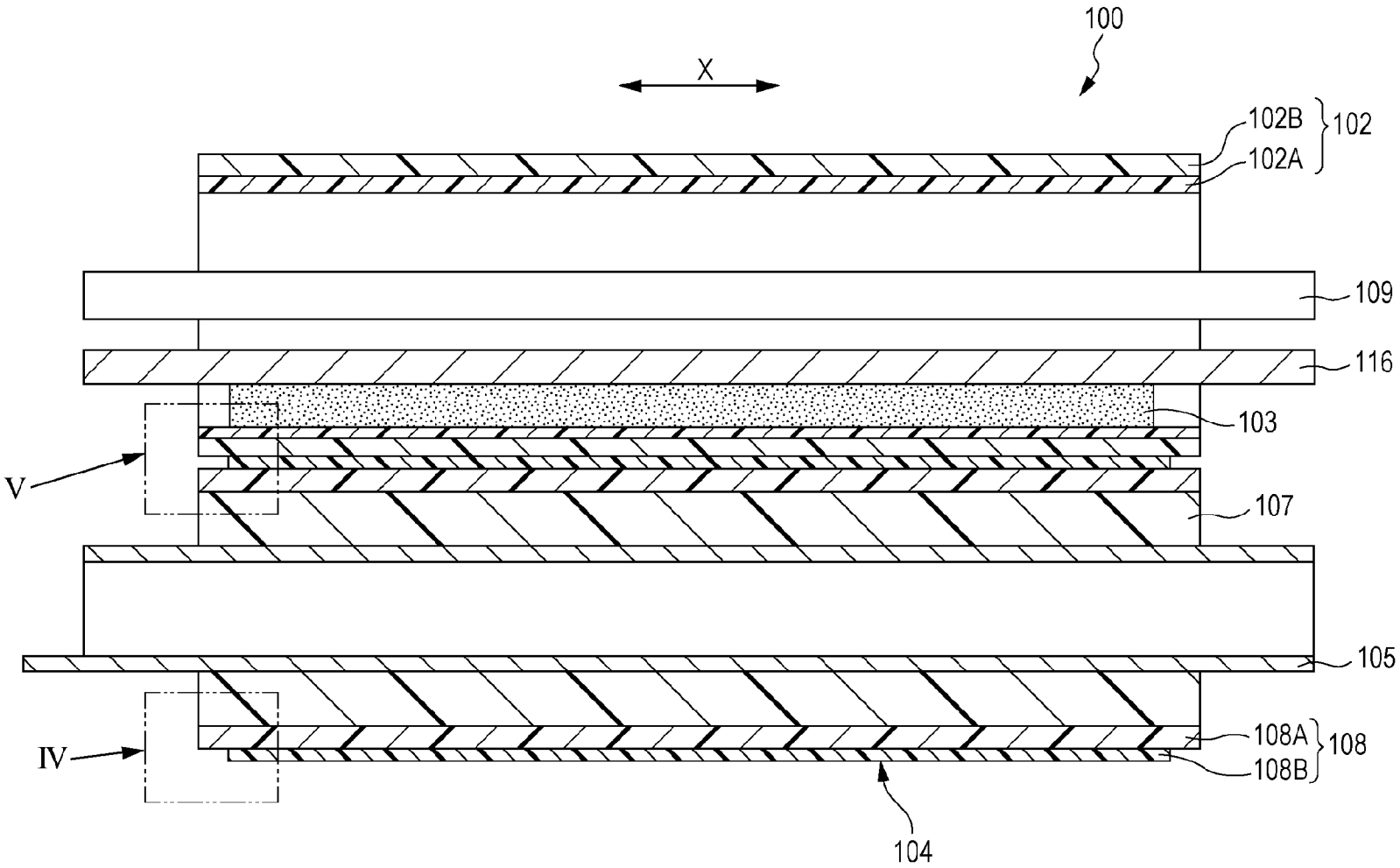
FIG. 3 is a sectional view of the pressure roller and a fixing belt according to the first exemplary embodiment in a width direction.

FIG. 1 schematically illustrates an example (a pressure roller) of the member for use in a fixing device according to the first exemplary embodiment. FIG. 2 illustrates an example (the first exemplary embodiment) of the configuration of a fixing device that includes the member for use in a fixing device according to the first exemplary embodiment. FIG. 3 schematically illustrates a sectional view of the pressure roller and a fixing belt in the fixing device of the first exemplary embodiment in a width direction.

As illustrated in FIG. 1, a pressure roller 104 according to the first exemplary embodiment has a roll-like shape and includes a core body 105 that has a cylindrical shape, an elastic layer (base member) 107 that has a cylindrical shape or a substantially cylindrical shape and that is disposed over the outer peripheral surface of the core body 105, and a covering member 108 with which the outer peripheral surface of the elastic layer 107 is covered.

The covering member 108 is formed of a first release layer 108A (hereinafter sometimes referred to as an "inner release layer") and a second release layer 108B (hereinafter sometimes referred to as an "outer release layer") each of which contains a fluorocarbon resin, the first release layer 108A and the second release layer 108B being integrally stacked on top of one another, and the first release layer 108A being positioned between the second release layer 108B and the elastic layer 107. The outer release layer 108B is stacked on an area in the outer peripheral surface of the inner release layer 108A other than end portions of the outer peripheral surface of the inner release layer 108A in the width direction, and the coefficient of kinetic friction of each of the end portions of the outer peripheral surface of the inner release layer 108A in the width direction that are exposed is greater than the coefficient of kinetic friction of the outer peripheral surface of the outer release layer 108B.

Note that the width direction of the covering member 108 (the release layers 108A and 108B) is the X direction in FIG. 1 and is a direction parallel to a longitudinal direction of the pressure roller 104 and an axial direction of the core body 105.

The pressure roller 104 of the first exemplary embodiment is to be driven by, for example, a motor (not illustrated) so as to rotate.

Component members of the pressure roller of the first exemplary embodiment will now be specifically described below. Note that the materials, shapes, dimensions and the like of the component members, which will be described below, are examples, and these are not limited to the following examples.

(Core Body)

The core body 105 is a member that has a cylindrical shape and supports the elastic layer 107, which is disposed over the outer peripheral surface of the core body 105, and the covering member 108.

End portions of the core body 105 in the axial direction are rotatably supported by bearing members (not illustrated).

Examples of the material out of which the core body 105 is made include aluminum (e.g., A-5052), iron, SUS, a metal such as copper, an alloy, a ceramic, and a fiber reinforced metal (FRM), and the core body 105 may be made of a resin.

In addition, the shape of the core body 105 is not limited to a cylindrical shape (hollow) and may be a columnar shape (solid).

(Elastic Layer)

The elastic layer 107 that has a cylindrical shape or a substantially cylindrical shape is formed over the outer peripheral surface of the core body 105 in such a manner as to cover the outer peripheral surface of the core body 105 other than end portions of the outer peripheral surface of the core body 105 in the axial direction.

Examples of the material out of which the elastic layer 107 is made include various rubber materials. Examples of such various rubber materials include a urethane rubber, ethylene-propylene rubber (EPM), a silicone rubber, and a fluoro rubber (FKM), and in particular, a silicone rubber that has good heat resistance and good processability. Examples of the silicone rubber include a room temperature vulcanization (RTV) silicone rubber and high temperature vulcanization (HTV) silicone rubber, and more specifically, polydimethyl silicone rubber (MQ), methyl vinyl silicone rubber (VMQ), methyl phenyl silicone rubber (PMQ), and fluoro silicone rubber (FVMQ).

As an example, the elastic layer 107 is made of a silicone rubber and has a thickness of 6 mm.

Note that a bonding layer may be disposed between the core body 105 and the elastic layer 107.

(Covering Member)

The covering member 108 that has a cylindrical shape (tube-like shape) is disposed over the outer peripheral surface of the elastic layer 107.

The covering member 108 has a multilayer structure in which the inner release layer 108A and the outer release layer 108B, each of which contains a fluorocarbon resin, are integrated with each other, and end portions of the outer peripheral surface of the inner release layer 108A in the width direction are exposed.

—First Release Layer (Inner Release Layer)—

The inner release layer 108A contains the first fluorocarbon resin and is disposed in such a manner as to cover the outer peripheral surface of the elastic layer 107.

Examples of the fluorocarbon resin out of which the inner release layer 108A is made include tetrafluoroethylene/perfluoroalkyl vinyl ether copolymer (PFA), polytetrafluoroethylene (PTFE), tetrafluoroethylene/hexafluoropropylene copolymer (FEP), polyethylene-tetrafluoroethylene (ETFE), polyvinylidene difluoride (PVDF), polychlorotrifluoroethylene (PCTFE), and polyvinyl fluoride (PVF). Among these, PFA and FEP are preferable as the fluorocarbon resin.

It is desirable that the thickness of the inner release layer 108A be set to be 5 μm or more and 100 μm or less.

—Second Release Layer (Outer Release Layer)—

The outer release layer 108B contains the second fluorocarbon resin and is stacked on an area in the outer peripheral surface of the inner release layer 108A other than the end portions of the outer peripheral surface of the inner release layer 108A in the width direction, and the end portions of the outer peripheral surface of the inner release layer 108A (exposed surfaces) are exposed at the ends of the pressure roller 104 in the width direction. The coefficient of kinetic friction of each of the exposed surfaces of the inner release layer 108A is greater than the coefficient of kinetic friction of the outer peripheral surface of the outer release layer 108B.

Note that coefficient of kinetic friction in the first exemplary embodiment is a value that is obtained by the following measurement.

More specifically, a release layer sample that is cut out from the member for use in a fixing device of the first exemplary embodiment is used as a sample to be measured, and this sample is measured by using a friction coefficient measuring instrument (Friction Player FPR-2000 manufactured by Rhesca Co., Ltd.).

In the pressure roller 104 according to the first exemplary embodiment in a fixing device 100, the outer peripheral surface of the outer release layer 108B comes into contact with a recording medium P, and the exposed surfaces of the inner release layer 108A at the ends of the pressure roller 104 in the width direction come into contact with the outer peripheral surface of a fixing belt 102. If the thickness of the outer release layer 108B is too small, the inner release layer 108A is likely to be exposed in an area (a sheet-passing area) other than at the end portions of the pressure roller 104 in the width direction as a result of the outer release layer 108B being worn away, and if the thickness of the outer release layer 108B is too large, friction that is generated between the exposed surfaces of the inner release layer 108A at the ends of the pressure roller 104 in the width direction and the fixing belt 102 decreases. From this standpoint, it is desirable that the thickness of the outer release layer 108B be 5 μm or more and 100 μm or less.

Examples of the material out of which the outer release layer 108B is made include the above-mentioned materials that are examples of the fluorocarbon resin out of which the inner release layer 108A is made.

The fluorocarbon resins that are contained in the release layers 108A and 108B may be selected in such a manner that each of the exposed surfaces of the inner release layer 108A has a coefficient of kinetic friction greater than that of the outer peripheral surface of the outer release layer 108B. For example, the first fluorocarbon resin, which is contained in the inner release layer 108A, and the second fluorocarbon resin, which is contained in the outer release layer 108B, may be different types of fluorocarbon resins. However, in order to suppress separation of the inner release layer 108A and the outer release layer 108B, the first fluorocarbon resin and the second fluorocarbon resin may be similar types of fluorocarbon resins. Even in the case where the first fluorocarbon resin and the second fluorocarbon resin are similar types of fluorocarbon resins, the coefficient of kinetic friction of the inner release layer 108A may be set to be greater than the coefficient of kinetic friction of the outer release layer 108B by, for example, using the first fluorocarbon resin that has a melt flow rate (MFR) greater than the MFR of the second fluorocarbon resin.

Note that melt flow rate (MFR) in the first exemplary embodiment is 372° C. and is a value that is measured in accordance with JIS K 7210 under a condition of a load of 5 kgf.

The release layers 108A and 108B may contain various additives. Examples of such additives include a conductive material (carbon black or the like), a filler (calcium carbonate or the like), a softener (paraffin-based or the like), a processing material (stearic acid or the like), an age resistor (amine-based or the like), a curing agent (sulfur, metal oxide, peroxide, or the like), and a functional filler (alumina or the like).

—Fabrication Method of Covering Member—

A method of fabricating the covering member 108 is not particularly limited as long as the covering member 108 has a configuration in which the outer release layer 108B is stacked on the outer peripheral surface of the inner release layer 108A in such a manner that the end portions of the inner release layer 108A in the width direction are exposed.

For example, a tubular member that has a two-layer structure is fabricated by two-layer extrusion using a two-layer extruder that includes an extrusion head such as a cross head or a double head, which is capable of performing two-layer extrusion, in such a manner that the inner release layer 108A, which has a large coefficient of kinetic friction, is positioned at the inner side and that the outer release layer 108B, which has a small coefficient of kinetic friction, is positioned at the outer side.

Note that in the case where the inner release layer 108A and the outer release layer 108B are made out of similar types of fluorocarbon resins, the MFR of each of the release layers 108A and 108B may be adjusted by, for example, adjusting an extrusion temperature. For example, in the case where each of the release layers 108A and 108B is formed by performing extrusion molding on a fluorocarbon resin, as the extrusion temperature becomes higher, the molecular chain length of the fluorocarbon resin decreases, and the MFR is likely to decrease. Therefore, a two-layer tubular member that includes the inner release layer 108A that has a relatively large coefficient of kinetic friction and the outer release layer 108B that has a relatively small coefficient of kinetic friction is obtained by performing extrusion molding at a relatively high temperature for the inner release layer 108A and performing extrusion molding at a relatively low temperature for the outer release layer 108B.

For example, such a tubular member is fabricated by performing two-layer extrusion molding by using a PFA resin in such a manner that the MFR of the inner release layer 108A is 3.0 g/10 min or more and less than 4.5 g/10 min and that the MFR of the outer release layer 108B is 1.8 g/10 min or more and less than 3.0 g/10 min or less.

Figure 4:
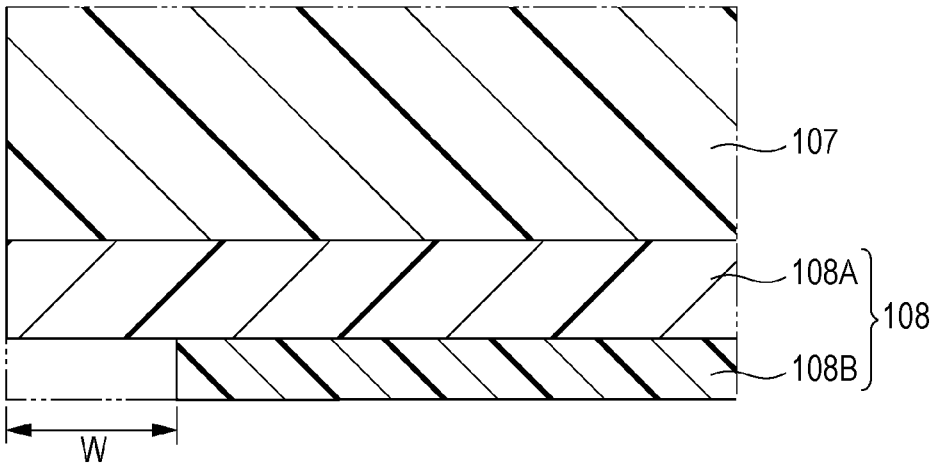
FIG. 4 is an enlarged schematic sectional view of a portion of the member for use in a fixing device in an area IV illustrated in FIG. 3.

Then, the tubular member having a two-layer structure that has been obtained by two-layer extrusion molding is cut in such a manner as to have a length that corresponds to the length of the elastic layer 107, and the inner release layer 108A is exposed at the ends of the tubular member in the width direction (the longitudinal direction) of the tubular member as illustrated in FIG. 4 by removing portions of the outer release layer 108B in end areas D by cutting or the like.

A width W of each of the end portions of the tubular member from which the outer release layer 108B is removed (the width of each of the exposed surfaces of the inner release layer 108A) may be set within a range such that, in the fixing device 100, the recording medium P that has a maximum width does not make contact with the exposed surfaces of the inner release layer 108A, and such that transmission of a driving force to the fixing belt 102 that is realized by a contact between the exposed surfaces of the inner release layer 108A and the fixing belt 102 is secured.

The sum of the widths W of the exposed surfaces of the inner release layer 108A may be, for example, 5% or more and 15% or less and preferably, 5% or more and 10% or less of the whole width of the covering member 108.

Note that in the alternative method of fabricating the covering member 108, for example, after the outer peripheral surface of the elastic layer 107 has been covered with the inner release layer 108A, the inner release layer 108A may be covered with the outer release layer 108B in such a manner that the end portions of the outer peripheral surface of the inner release layer 108A are exposed.

<Fixing Device>

A fixing device according to the first exemplary embodiment will now be described.

The fixing device according to the first exemplary embodiment includes a first rotating body that includes the member for use in a fixing device, a second rotating body that defines a nip area, in which a recording medium is to be nipped, by making contact with the outer peripheral surface of the member for use in a fixing device of the first rotating body, and a heating unit that heats at least one of the first rotating body and the second rotating body.

First Exemplary Embodiment

As illustrated in FIG. 2, the fixing device 100 of the first exemplary embodiment includes a housing 101 that has openings each of which allows the recording medium P to move into or out of the housing 101. The pressure roller 104, which is an example of the first rotating body, the fixing belt 102, which is an example of the second rotating body (another member), halogen heaters 109, each of which is an example of the heating unit and each of which heats the fixing belt 102, are disposed in an area inside the housing 101. A portion of the outer peripheral surface of the pressure roller 104 and a portion of the outer peripheral surface of the fixing belt 102 are in contact with each other in an area in such a manner as to define a nip area (sometimes referred to as a nip part) N in which the recording medium P is to be nipped and in which a toner image T is to be fixed onto the recording medium P.

A pad member 103 that opposes the pressure roller 104 with the fixing belt 102 nipped therebetween and a temperature sensor 112 that measures the temperature of the outer peripheral surface of the fixing belt 102 are disposed in the area inside the housing 101. Descriptions of a guiding member that guides the recording medium P to the nip part N and a separating member that separates the recording medium P from the fixing belt 102 will be omitted, and the guiding member and the separating member are not illustrated in the drawings.

[Pressure Roller]

The pressure roller 104 is the above-described member for use in a fixing device according to the first exemplary embodiment and includes the core body 105, which has a cylindrical shape, the elastic layer 107, the covering member 108 that is formed of the inner release layer 108A and the outer release layer 108B, which are stacked on top of one another. The pressure roller 104 has a configuration in which the portions of the outer peripheral surface of the inner release layer 108A are exposed at the ends of the covering member 108 in the width direction.

[Fixing Belt]

As illustrated in FIG. 3, the fixing belt 102 includes a base member 102A that is formed in an endless loop shape and a release layer 102B that is stacked on the outer peripheral surface of the base member 102A.

As an example, the base member 102A is made of a polyimide and has a thickness of 200 μm. It is desirable that the thickness of the base member 102A be set to be 500 μm or less, and more desirably, 30 μm or more and 300 μm or less.

As an example, the release layer 102B is made of PFA and has a thickness of 100 μm. It is desirable that the thickness of the release layer 102B be set to be 30 μm or more and 300 μm or less.

Description of ring-shaped cap members that are made of a resin and are usually attached to end portions of the fixing belt 102 in the width direction in order to keep the cross-sectional shape of each of the end portions in a circular shape will be omitted, and the ring-shaped cap members are not illustrated in the drawings.

(Pad Member)

The pad member 103 is a member that has a rectangular parallelepiped shape and has a longitudinal direction that is parallel to the width direction of the fixing belt 102 (the X direction in FIG. 3), and the pad member 103 is made of a urethane rubber. A surface of the pad member 103 on the side on which the halogen heaters 109 are present is fixed to a support member 116, which is made of aluminum, with an adhesive, and a surface of the pad member 103 on the side opposite to that on which the halogen heaters 109 are present is in contact with the inner peripheral surface of the fixing belt 102. The ends of the support member 116 in the longitudinal direction are fixed to the housing 101 via brackets (not illustrated).

[Halogen Heater]

As illustrated in FIG. 2, the two halogen heaters 109 are provided as an example, and the halogen heaters 109 are configured to perform energization or stop energization on the basis of a difference between a temperature that is measured by the temperature sensor 112, which will be described later, and a fixation setting temperature. In addition, tungsten wires (not illustrated) are disposed in areas inside the halogen heaters 109, and the tungsten wires emit light as a result of being energized, so that the halogen heaters 109 heat the fixing belt 102 and indirectly heat the pressure roller 104.

Note that the heating unit is not limited to the halogen heaters 109 and may be a sheet-shaped heater that is in contact with the inner peripheral surface of the fixing belt 102. Alternatively, the heating unit may be a unit that heats a thermal layer, which is made of copper or the like and is formed on the fixing belt 102, by using an electromagnetic induction effect of a magnetic field that is generated as a result of applying a current to a coil.

(Temperature Sensor)

As illustrated in FIG. 2, the temperature sensor 112 is positioned further downstream than the nip part N in a rotation direction of the fixing belt 102 in such a manner as to be spaced apart from the outer peripheral surface of the fixing belt 102. In addition, as an example, the temperature sensor 112 is disposed at one position facing a center portion of the fixing belt 102 in the width direction.

Furthermore, the temperature sensor 112 is configured to transmit temperature data that is measured by the temperature sensor 112 to a controller (not illustrated) of an image forming apparatus. The controller is configured to perform energization or stop energization of the halogen heaters 109 in order to bring the difference between the fixation setting temperature of the fixing belt 102, which has been set in advance, and a temperature that is measured by the temperature sensor 112 close to zero.

Figure 5:
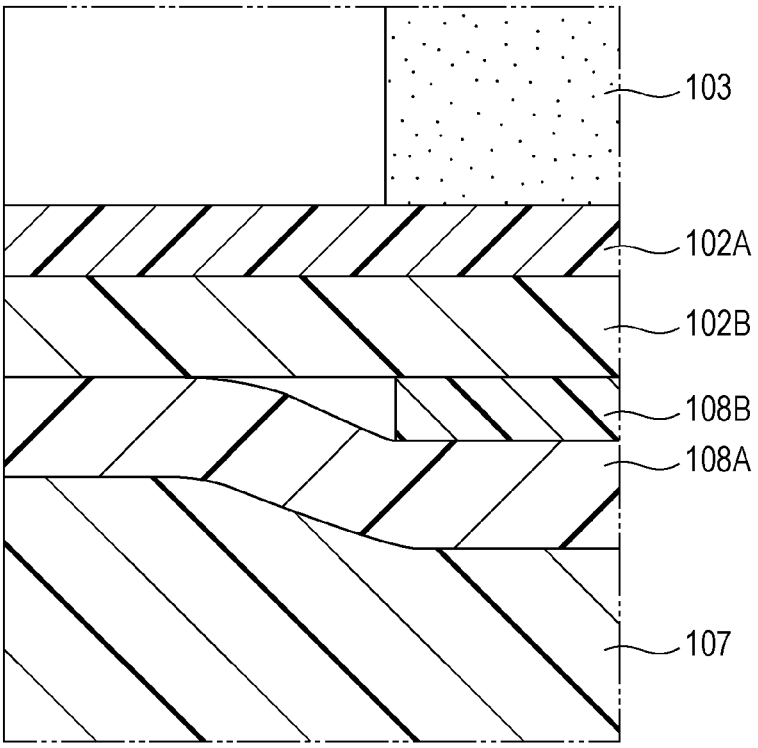
FIG. 5 is a schematic diagram illustrating a contact state between the pressure roller and the fixing belt in an end area V illustrated in FIG. 3.

In the fixing device 100 of the first exemplary embodiment, which has the above-described configuration, the pressure roller 104 applies pressure to the outer peripheral surface of the fixing belt 102, so that, as illustrated in FIG. 5, each of the portions of the inner release layer 108A, which are exposed at the ends of the outer peripheral surface of the pressure roller 104 in the width direction, makes contact with a corresponding one of the end portions of the outer peripheral surface of the fixing belt 102 that faces the portion of the inner release layer 108A. A driving force is transmitted between the fixing belt 102 and the pressure roller 104 as the pressure roller 104 is driven so as to rotate, and the fixing belt 102 is driven and rotates (moves circularly).

Here, the coefficient of kinetic friction of the inner release layer 108A with respect to the fixing belt 102 is greater than the coefficient of kinetic friction of the outer release layer 108B with respect to the fixing belt 102. Thus, a frictional force that is larger than a frictional force that acts on the center portion of the fixing belt 102 acts on the end portions of the fixing belt 102 in the width direction by a contact between the fixing belt 102 and the inner release layer 108A, so that the transmission of the driving force between the fixing belt 102 and the pressure roller 104 becomes stabilized (the fixing belt 102 is resistant to slipping). In addition, since the inner release layer 108A, which is made of a fluorocarbon resin, makes contact with the fixing belt 102 at the ends of the pressure roller 104 and a driving force is transmitted, contamination of the end portions of the pressure roller 104 and a reduction in the transmission of the driving force due to adhesion of foreign objects are suppressed.

Note that, in the fixing device 100, the recording medium P, which has a maximum width in the width direction of the pressure roller 104, passes through, when the toner image T is fixed onto the recording medium P, the nip part N, which is defined by the fixing belt 102 and the outer release layer 108B of the pressure roller 104, and does not pass through a portion in which the fixing belt 102 and the inner release layer 108A of the pressure roller 104 make contact with each other.

Second Exemplary Embodiment

An example of a fixing device according to the second exemplary embodiment will now be described. Note that members and portions that are basically the same as those of the above-described first exemplary embodiment are denoted by the same reference numerals as used in the first exemplary embodiment, and repeated descriptions thereof will be omitted.

Figure 6:
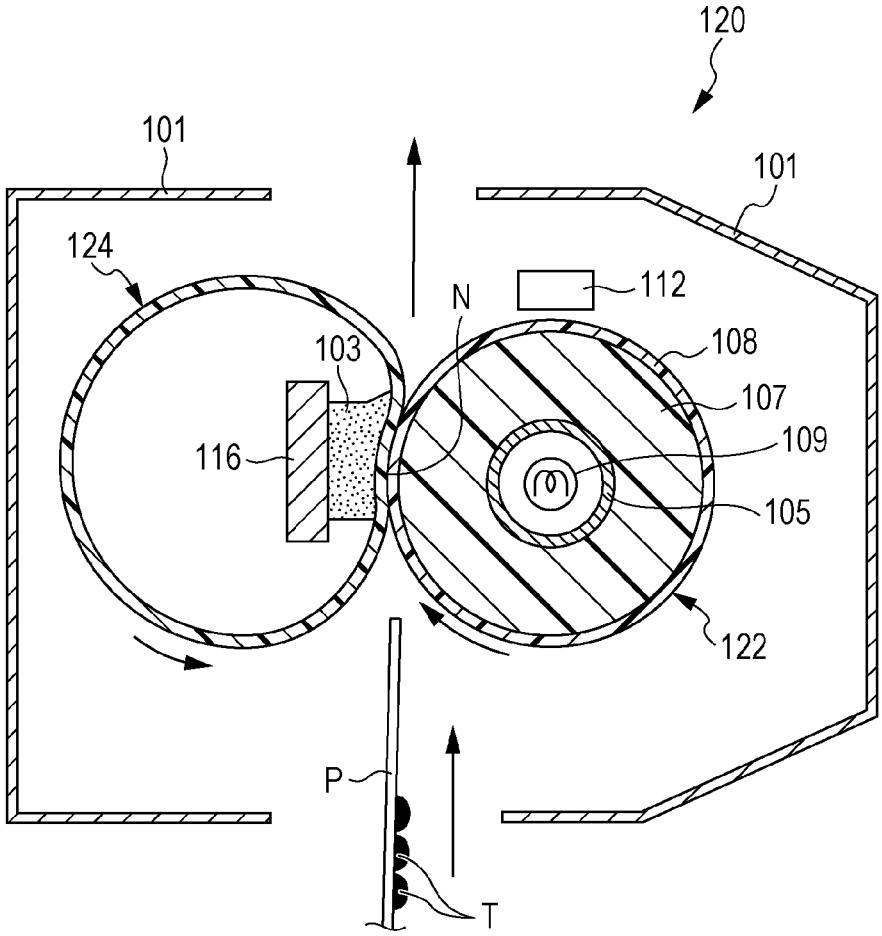
FIG. 6 is a schematic diagram illustrating the configuration of a fixing device according to a second exemplary embodiment.

FIG. 6 illustrates a fixing device 120 of the second exemplary embodiment. The fixing device 120 includes a fixing roller 122, which is an example of a first rotating body, a pressure belt 124, which is an example of a second rotating body, and a halogen heater 109 that heats the fixing roller 122.

As an example, the fixing roller 122 has a configuration that is the same as that of the pressure roller 104 of the first exemplary embodiment (see FIG. 1).

The halogen heater 109 is disposed in an area inside a core body 105 in such a manner as not to be in contact with the core body 105, and the temperature of the fixing roller 122 is to be measured by a temperature sensor 112. In addition, the fixing roller 122 is configured to be driven by a motor (not illustrated) so as to rotate.

As an example, the pressure belt 124 has a configuration that is the same as that of the fixing belt 102 of the first exemplary embodiment (see FIG. 2). A pad member 103 that is used for pressing the pressure belt 124 against the fixing roller 122 in such a manner as to define a nip part N is disposed in an area inside the pressure belt 124. As a result, the fixing roller 122 applies pressure to a recording medium P together with the pressure belt 124.

In the fixing device 120, since the halogen heater 109 is disposed in the area inside the fixing roller 122, the fixing roller 122 is directly heated by the halogen heater 109.

Although the case where, in the fixing device 100 of the above-described first exemplary embodiment and the fixing device 120 of the above-described second exemplary embodiment, the outer peripheral surface of each of the roll-shaped members (the pressure roller 104 and the fixing roller 122) is formed of the covering member 108 that includes the two release layers 108A and 108B, which are stacked on top of one another, and where the outer peripheral surface of the inner release layer 108A is exposed at the ends of each of the roll-shaped members in the width direction has been described, the covering member 108, which has such a configuration, may be applied to a release layer of each of the belt-shaped members (the fixing belt 102 and the pressure belt 124). Also in the case where such a belt is provided, a frictional force is exerted by a contact between an inner release layer, which is exposed at ends of the belt in the width direction, and a roller. Thus, transmission of a driving force between the belt and the roller becomes stabilized, and the belt is driven and rotates (moves circularly) as the roller is driven so as to rotate. Since an elastic layer or an elastic member is not exposed at a portion where the belt and the roller are in contact with each other, contamination is suppressed.

<Image Forming Apparatus>

An image forming apparatus according to the first exemplary embodiment includes an image carrier, an electrostatic latent image forming device that forms an electrostatic latent image on a surface of the image carrier, a developing device that develops the electrostatic latent image with toner and forms a toner image, a transfer device that transfers the toner image onto a recording medium, and the fixing device of the above-described first exemplary embodiment that fixes the toner image onto the recording medium.

Figure 7:
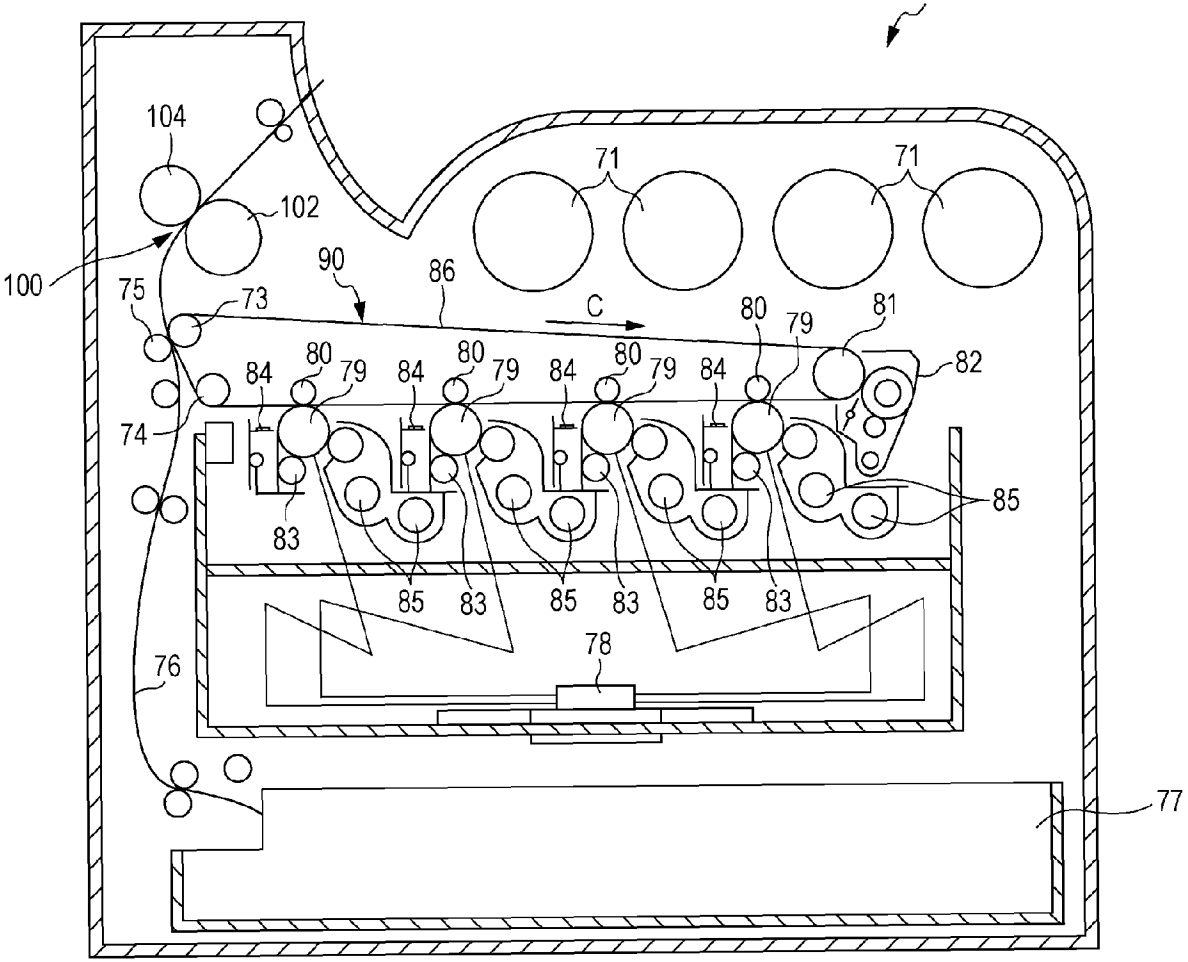
FIG. 7 is a schematic diagram illustrating an example of the overall configuration of an image forming apparatus according to the first exemplary embodiment.

FIG. 7 is a schematic diagram illustrating an example of the configuration of a tandem type image forming apparatus that includes the fixing device 100 according to the first exemplary embodiment, which is illustrated in FIG. 2.

In an image forming apparatus 10, a charging roller 83, a developing device 85, a first transfer roller 80 that is disposed in such a manner that an intermediate transfer belt 86 is interposed between the first transfer roller 80 and a corresponding one of photoconductors 79, and a photoconductor cleaning member 84 are disposed around the periphery of each of the photoconductors 79 in this order in a counterclockwise direction, and these pairs of members form developing units each of which corresponds to a different color. Each of the developing units is provided with a toner cartridge 71 that replenishes a corresponding one of the developing devices 85 with a developer, and a laser generating device 78 that radiates laser beams, which correspond to image information, onto portions of surfaces of the photoconductors 79 of the developing units each of which is positioned downstream of the corresponding charging roller 83 and upstream of the corresponding developing device 85 (in a rotation direction of the photoconductors 79) is provided.

In the image forming apparatus 10, the four developing units each of which corresponds to one of four colors (e.g., cyan, magenta, yellow, and black) are arranged in series in the horizontal direction, and the intermediate transfer belt 86 is disposed in such a manner as to be inserted through transfer areas that are defined by the photoconductors 79 of the four developing units and the corresponding first transfer rollers 80. The intermediate transfer belt 86 is applied with a tension, supported, and driven by a support roller 73, a support roller 74, and a driving roller 81, which are disposed on the inner surface of the intermediate transfer belt 86 in this order in the counterclockwise direction, and forms a belt driving device 90. Note that the four first transfer rollers 80 are positioned downstream of the support roller 73 and upstream of the support roller 74 (in a rotation direction of the intermediate transfer belt 86). A transfer cleaning member 82 that cleans the outer peripheral surface of the intermediate transfer belt 86 is disposed so as to oppose the driving roller 81 across the intermediate transfer belt 86 in such a manner as to be in contact with the driving roller 81.

A second transfer roller 75 that is used for transferring a toner image that has been formed on the outer peripheral surface of the intermediate transfer belt 86 onto a surface of a recording sheet that is to be transported from a sheet feed unit 77 via a sheet path 76 is disposed so as to oppose the support roller 73 across the intermediate transfer belt 86 in such a manner as to be in contact with the support roller 73.

The sheet feed unit 77 that accommodates a recording medium is disposed in a bottom portion of the image forming apparatus 10, and the recording medium is fed from the sheet feed unit 77 via the sheet path 76 in such a manner as to pass through a contact portion where the support roller 73 and the second transfer roller 75 are in contact with each other and which forms a second transfer section. The recording medium that has passed through the contact portion is further transported by a transport unit (not illustrated) in such a manner as to be inserted through a nip part of the fixing device 100 and eventually is discharged outside the image forming apparatus 10.

An image forming method using the image forming apparatus 10 illustrated in FIG. 7 will now be described. Formation of a toner image is performed in each of the developing units. The surfaces of the photoconductors 79, which rotate in the counterclockwise direction, are charged by the corresponding charging rollers 83, and after that, latent images (electrostatic latent images) are formed on the surfaces of the photoconductors 79, which have been charged, by the laser generating device 78 (an exposure device). Next, the latent images are developed with developers that are supplied from the developing devices 85 in such a manner as to form toner images, and the toner images each of which has been delivered to a portion where one of the first transfer rollers 80 and the corresponding photoconductor 79 are in contact with each other are transferred onto the outer peripheral surface of the intermediate transfer belt 86 that rotates in the direction of arrow C. Note that, after the toner images have been transferred to the outer peripheral surface of the intermediate transfer belt 86, toner, dust, and the like that have been adhered to the surfaces of the photoconductors 79 are cleaned by the photoconductor cleaning members 84, and the photoconductors 79 are prepared for the next formation of toner images.

The toner images that have been developed in the developing units for the corresponding colors are delivered to the second transfer section in a state of being sequentially superposed with one another on the outer peripheral surface of the intermediate transfer belt 86 in such a manner as to correspond to image information and are transferred onto the surface of the recording sheet that has been transported from the sheet feed unit 77 via the sheet path 76 by the second transfer roller 75. The recording sheet to which the toner images have been transferred is applied with pressure and heated when the recording sheet further passes through the nip part of the fixing device 100, so that the toner images are fixed onto the recording sheet. After an image has been formed on the surface of the recording medium, the recording medium is discharged outside the image forming apparatus 10.

Then, in the fixing device 100, the fixing belt 102 is driven along with a rotation of the pressure roller 104, and contamination of the end portions of the pressure roller 104 in the width direction is suppressed while the ability of an area, through which the recording medium passes, to allow the recording medium to easily separate therefrom is maintained. Therefore, an image defect (e.g., image irregularities or the like) due to the transmission state of a driving force to the fixing belt 102 or the contamination is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A member for use in a fixing device comprising:

a base member that has a substantially cylindrical shape; and a covering member covering an outer peripheral surface of the base member, the covering member including:

a first release layer that contains a first fluorocarbon resin; and a second release layer that contains a second fluorocarbon resin, wherein the second release layer is stacked on an area of an outer peripheral surface of the first release layer other than end portions of the outer peripheral surface of the first release layer in a width direction, wherein a coefficient of kinetic friction of the outer peripheral surface of the first release layer that is exposed at the end portions is greater than a coefficient of kinetic friction of an outer peripheral surface of the second release layer.

2. The member for use in a fixing device according to claim 1, further comprising:

a core body, wherein the base member is an elastic layer that is disposed over an outer peripheral surface of the core body.

3. The member for use in a fixing device according to claim 1, wherein the first fluorocarbon resin and the second fluorocarbon resin are similar types of fluorocarbon resins.

4. The member for use in a fixing device according to claim 2, wherein the first fluorocarbon resin and the second fluorocarbon resin are similar types of fluorocarbon resins.

5. A fixing device comprising:

a first rotating body that includes the member for use in a fixing device according to claim 1;

a second rotating body that defines a nip area, in which a recording medium is to be nipped, by making contact with an outer peripheral surface of the member for use in a fixing device of the first rotating body; and a heating unit configured to heat at least one of the first rotating body and the second rotating body.

6. A fixing device comprising:

a first rotating body that includes the member for use in a fixing device according to claim 2;

a second rotating body that defines a nip area, in which a recording medium is to be nipped, by making contact with an outer peripheral surface of the member for use in a fixing device of the first rotating body; and a heating unit configured to heat at least one of the first rotating body and the second rotating body.

7. A fixing device comprising:

a first rotating body that includes the member for use in a fixing device according to claim 3;

a second rotating body that defines a nip area, in which a recording medium is to be nipped, by making contact with an outer peripheral surface of the member for use in a fixing device of the first rotating body; and a heating unit configured to heat at least one of the first rotating body and the second rotating body.

8. A fixing device comprising:

a first rotating body that includes the member for use in a fixing device according to claim 4;

a second rotating body that defines a nip area, in which a recording medium is to be nipped, by making contact with an outer peripheral surface of the member for use in a fixing device of the first rotating body; and a heating unit configured to heat at least one of the first rotating body and the second rotating body.

9. An image forming apparatus comprising:

an image carrier;

an electrostatic latent image forming device configured to form an electrostatic latent image on a surface of the image carrier;

a developing device configured to develop the electrostatic latent image with toner and to form a toner image;

a transfer device configured to transfer the toner image onto a recording medium; and the fixing device according to claim 5 configured to fix the toner image onto the recording medium.

10. An image forming apparatus comprising:

an image carrier;

an electrostatic latent image forming device configured to form an electrostatic latent image on a surface of the image carrier;

a developing device configured to develop the electrostatic latent image with toner and to form a toner image;

a transfer device configured to transfer the toner image onto a recording medium; and the fixing device according to claim 6 configured to fix the toner image onto the recording medium.

11. An image forming apparatus comprising:

an image carrier;

an electrostatic latent image forming device configured to form an electrostatic latent image on a surface of the image carrier;

a developing device configured to develop the electrostatic latent image with toner and forms a toner image;

a transfer device configured to transfer the toner image onto a recording medium; and the fixing device according to claim 7 configured to fix the toner image onto the recording medium.

12. An image forming apparatus comprising:

an image carrier;

an electrostatic latent image forming device configured to form an electrostatic latent image on a surface of the image carrier;

a developing device configured to develop the electrostatic latent image with toner and to form a toner image;

a transfer device configured to transfer the toner image onto a recording medium; and the fixing device according to claim 8 configured to fix the toner image onto the recording medium.

13. The member for use in a fixing device according to claim 1, wherein the first release layer primarily comprises the first fluorocarbon resin.

14. The member for use in a fixing device according to claim 1, wherein the first release layer does not contain any silicone rubber.

* * * * *